United States Patent [19]

Makino et al.

[11] Patent Number: 4,566,163

[45] Date of Patent: Jan. 28, 1986

[54] AUTOMATIC SUPERVISORY SYSTEM FOR A WARPER

[75] Inventors: Syozaburo Makino, Kawasaki; Keiji Yoshikawa, Yokohama; Tukayo Nakasho, Nishikasugai, all of Japan

[73] Assignee: Nippon Selen Co., Ltd., Kanagawa, Japan

[21] Appl. No.: 592,588

[22] Filed: Mar. 23, 1984

[30] Foreign Application Priority Data

Jun. 21, 1983 [JP] Japan ..... 58-111412

[51] Int. Cl.[4] ..... D02H 13/08

[52] U.S. Cl. ..... 28/187

[58] Field of Search ..... 28/187, 227; 364/470

[56] References Cited

U.S. PATENT DOCUMENTS

| | | | |
|---|---|---|---|
| 3,053,986 | 9/1962 | Loepfe et al. | 28/187 X |
| 3,258,824 | 7/1966 | Gith | 28/227 |
| 3,390,441 | 7/1968 | Felix | 28/227 |
| 3,456,310 | 7/1969 | Abe et al. | 28/187 |
| 3,887,814 | 6/1975 | Faulhaber | 28/227 X |
| 4,169,981 | 10/1979 | White et al. | 28/187 X |

FOREIGN PATENT DOCUMENTS

| | | | |
|---|---|---|---|
| 1274448 | 5/1972 | United Kingdom | 28/187 |
| 2092187 | 8/1982 | United Kingdom | 28/187 |

*Primary Examiner*—Robert R. Mackey

*Attorney, Agent, or Firm*—Koda and Androlia

[57] ABSTRACT

An automatic supervisory system for a warper comprising one or more detection units for detecting abnormality on the yarns to be wound up on the warper and a central control unit including means for indicating and recording the substance of abnormality and shutting down the warper drive upon detection of the abnormality. The detection unit comprises a detector, an amplifier and a priority indication device, and the central control unit includes indicators, counters and a switching mechanism. The indicator in the priority indication device is lighted by an output signal from the amplifier in the detection unit. This is synchronized with lighting of the pertinent indicator and operation of the corresponding counter in the central control unit, and the switching mechanism is also activated to stop the warping machine bed.

1 Claim, 4 Drawing Figures

AUTOMATIC SUPERVISORY SYSTEM FOR A WARPER

BACKGROUND OF THE INVENTION

This invention relates to an automatic supervisory system for a warper and more particularly to a device for detecting abnormality on the running yarns and, upon detection of abnormality, automatically stopping the warper and simultaneously indicating the location and substance of the abnormality.

As is well known, when the warping yarns are supplied into a loom in a weaving operation, the yarns must be paralleled to each other and wound up on a beam while maintaining such paralleled form. To put it more definitely, in the warping operation, the yarn wound up on the respective bobbins must be arranged in order on a creel in conformity to the intended weaving design involving the number and order of skeins to be supplied, warping length, warping density and warping width, and then the yarns must be reeled out, paralleled and wound up on a drum under a constant tension. Thus, in such warping operation, it is the prerequisites that the individual yarns have been wound substantially to a predetermined length, that the yarn knots such as slubs have been removed, and that the yarns are free of end breakage. In the actual practice of such warping operation, however, there tends to take place certain abnormal situations such as ends down due to unusual tension or double ends due to improper winding by the automatic reels in the preceding step or extra ends in the running yarn, and if warping is continued with such abnormalities left unattended, trouble is bound to arise in the succeeding steps of the weaving operation, resulting in the production of a defective fabric. The conventional means for avoiding such trouble incorporated an end break detector adopting drop wires connected to the respective yarns, such detector being installed in each creel and operated to make an electrical circuit upon detecting an end break to stop the rotation of the warping drum for making a repair work. It was also a conventional practice to keep a constant watch on the running yarns by the worker's eye and, upon detecting trouble, stop the warper by depressing a manual stop switch to make a proper repair work.

However, the drop wire type breakage detector could fail to make a perfect detection due to an improper operation resulting from mechanical friction or blocking of electrical contacts with lint or other dirt, while the detection by the visual watch was unable to follow high speed operation and would allow escape of trouble from the worker's notice. The latter means of detection would also cause a great deal of fatigue on the worker and was incapable of perfect prevention of end break or double ends.

In view of these problems in warping operation, the present inventors have made further studies for realizing the perfect prevention of end down or double ends and succeeded in achieving the present invention.

SUMMARY OF THE INVENTION

An object of the present invention, therefore, is to provide an automatic supervisory system for a warper which is capable of precisely and quickly detecting abnormalities on running yarns such as end break or double ends and, upon detecting such an abnormality, automatically shutting down the warper and simultaneously indicating the location of abnormality, thereby to facilitate the repair work and enable obtainment of the faultless beam.

Another object of the present invention is to provide an automatic supervisory system for a warper which is capable of indicating and recording an abnormality of a yarn such as double ends, an end break or the like to perceive an abnormality prior to a warping process, to thereby improve the quality control through an improvement in the warping process and highly increasing the winding speed of the warper to accomplish an improvement in production efficiency and product quality control.

Still another object of the present invention is to provide an automatic supervisory system for a warper which can be easily adapted between each creel and corresponding warping drum in an existing warper in a way such that the whole system will not obstruct the way of running yarns.

A further object of the present invention is to provide an automatic supervisory system for a warper in which all the elements are electronically operated with quick response to each other to keep free of mechanical trouble such as overtension and to enable correct and reliable operation of the system.

The automatic supervisory system of this invention comprises one or more detection units each integrally consisting of a detector provided for each yarn to be wound on warp beam and adapted to convert the variation in yarn diameter into an electrical signal and give out such signal, an amplifier connected to said detector for amplifying and shaping the output signal from said detector and issuing an output signal in the event of occurrence of abnormality on said yarn, and a priority indication device comprising a priority circuit connected to said amplifier and an indicator; and a central control unit connected to said priority indication device and having indicators and a switching mechanism connected to a warping machine bed stopping device. When an output signal is issued from the priority indication device upon receiving an output signal from the amplifier in said detection unit, the switching mechanism in said central control unit is activated to operate the warping machine bed stopping device to stop the machine bed. Said output signal also operates an indicator in the central control unit while making the priority circuit of the priority indication device in said detection unit so as to operate the indicator in said indication device corresponding to the detector which has actuated the amplifier to issue its first output signal.

Other objects, features and advantages of the present invention will become clear as the invention is more fully described below with reference to the accompanying drawings.

DETAILED DESCRIPTION OF THE INVENTION

Figure 1:
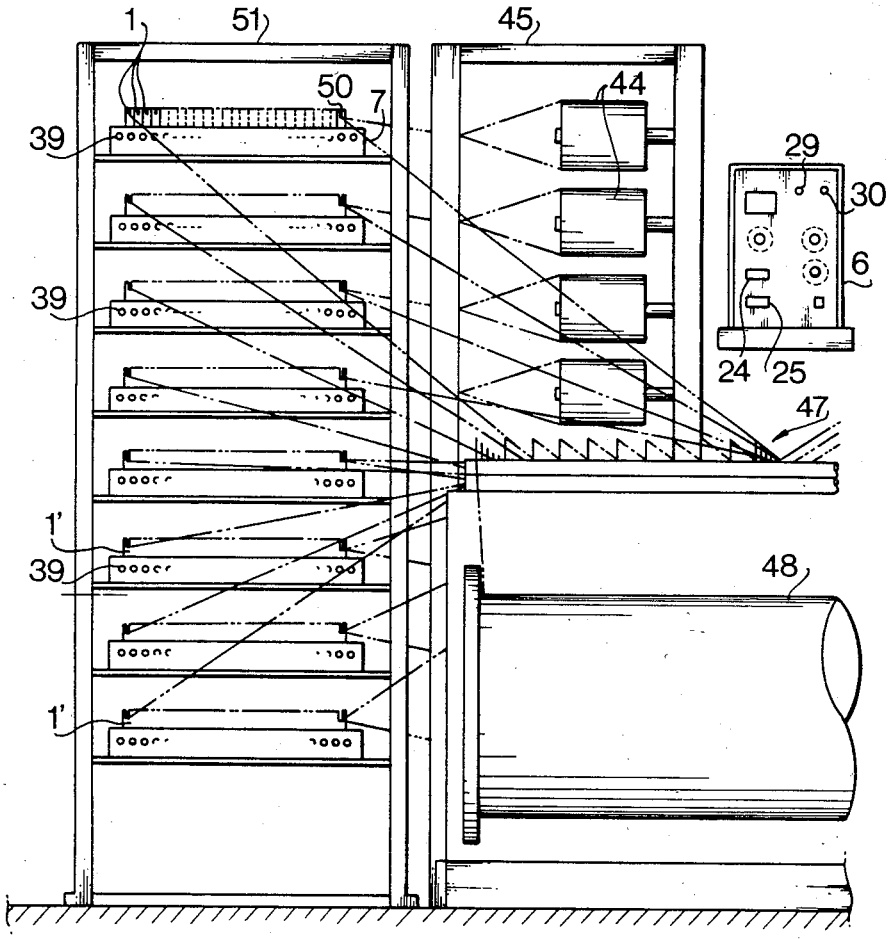
FIG. 1 is a frontal view, with half of one side eliminated, illustrating the layout of a warper in which the system of this invention is incorporated.
Figure 2:
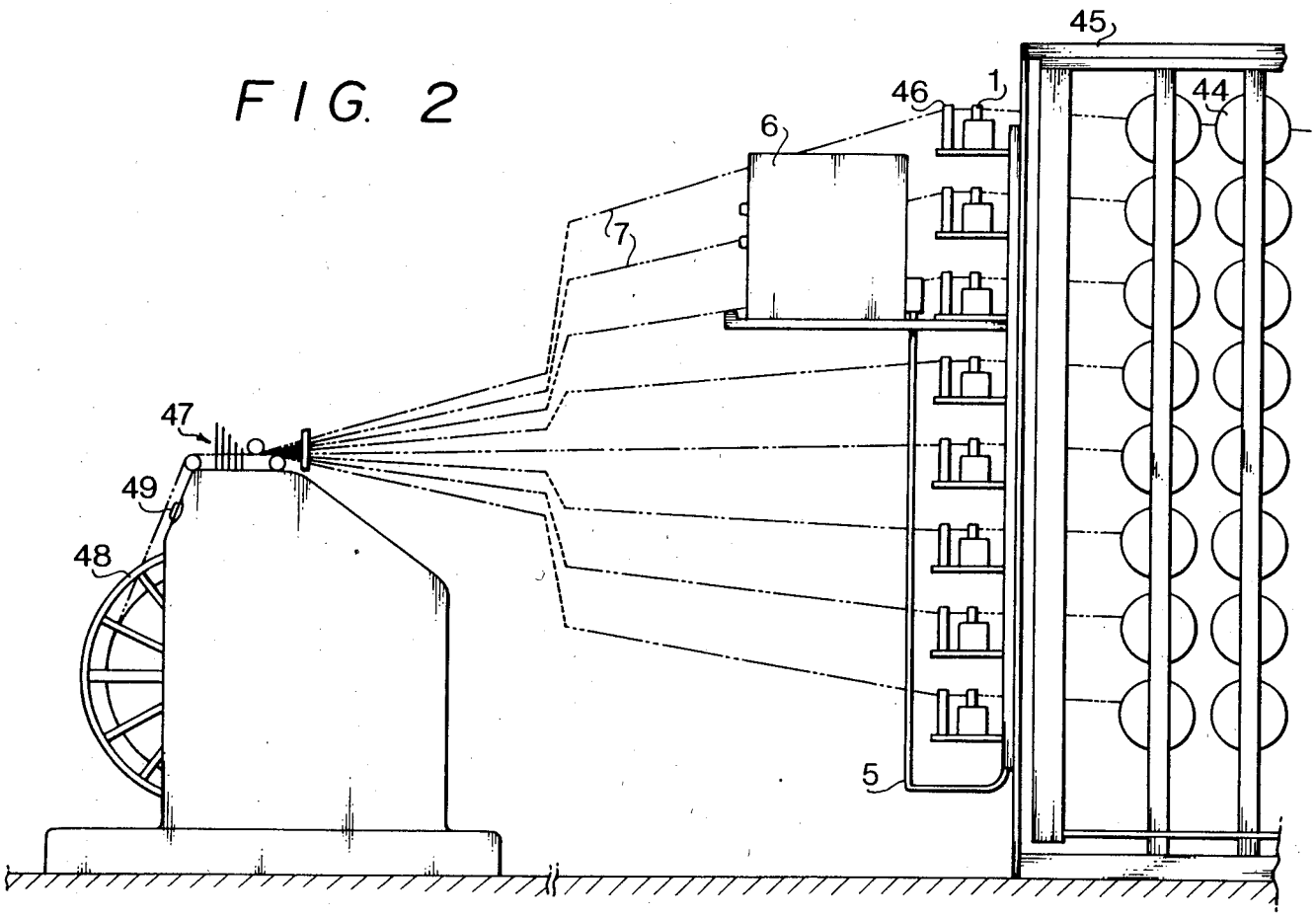
FIG. 2 is a side view of the warper, with the terminal portion of the creel and the half-way running courses of yarns eliminated from the drawing.

Referring to FIGS. 1 and 2, there is schematically shown the layout of a warper adapted with an automatic supervisory system in accordance with this invention.

The general setup of the warper is first described with reference to these drawings. It will be seen that a plurality of cheeses 44 are mounted in order in a creel 45. These cheeses can supply usually several hundred to a thousand pieces of yarn at one time. The yarn 7 which has wound off a cheese 44 passes through a guide 46, a zigzag comb and other elements and is wound up on a drum 48 at equal intervals. In the event an abnormality was detected on the yarn, a stop switch 49 is depressed to immediately stop the drum 48 and the pertinent repair work is done. A plurality of detection units 1, which will be described in detail later, are provided in correspondence to the respective yarns 7. Each yarn 7 runs in a yarn guide 50 provided to the corresponding detection unit 1. Each detection unit 1 has an indicator 39 which is easily perceivable from a distance. Twenty to sixty of these detection units 1 are arranged parallel to each other to form a group of detection units 1'. Many of these groups of detection units 1' are disposed in order in a single casing 51, and they are arranged parallel to each other in ranks in conformity to the levels of the yarns 7 supplied from the respective cheeses 44 in the creel 45. Said groups of detection units 1' are also connected to a central control unit 6 by a control line bundle 5. On the panel of the control unit 6 are provided an end break indicator 29, a double ends indicator 30, an end break counter 24, a double ends counter 25 and other operating elements.

Figure 3:
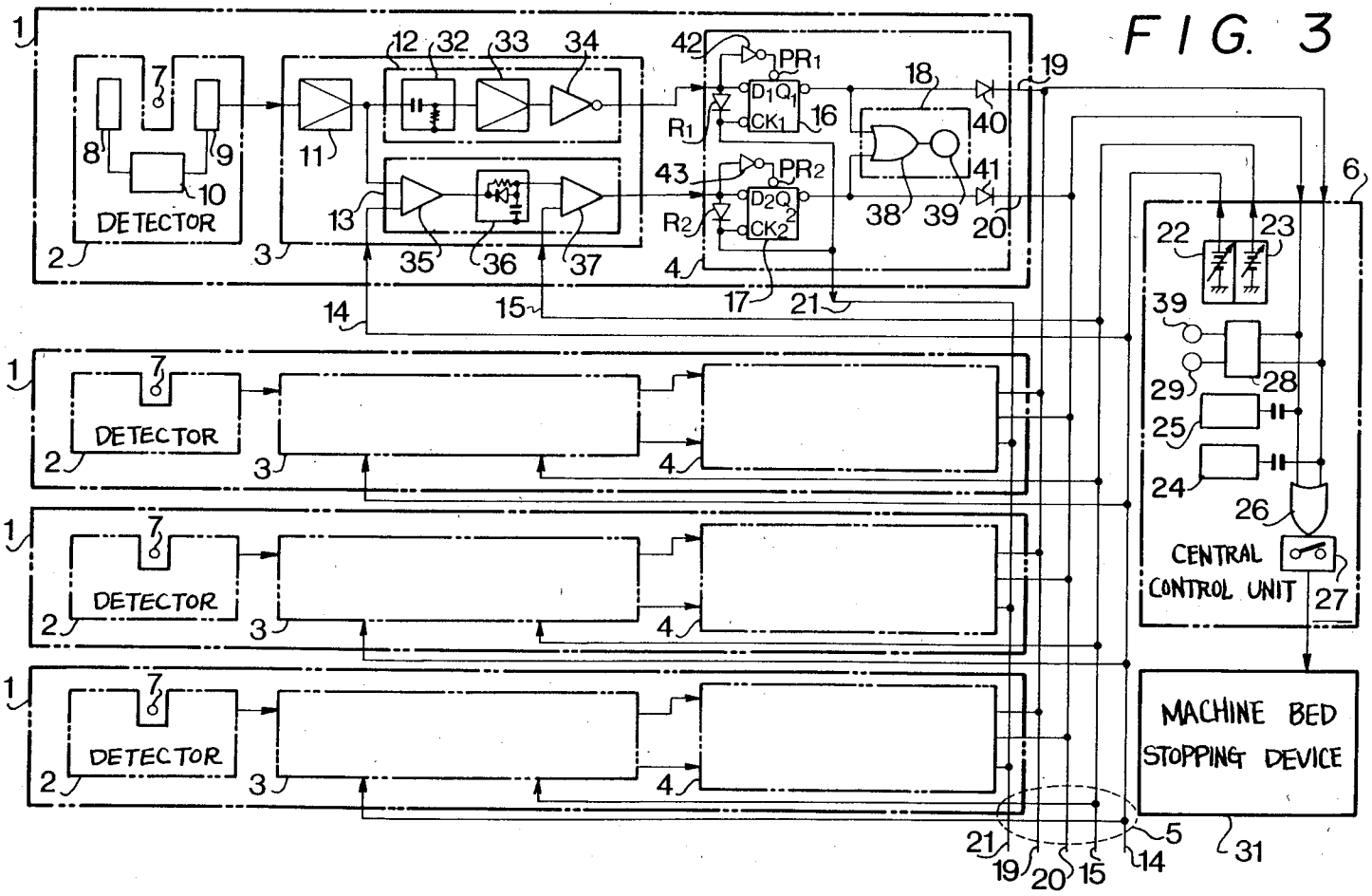
FIG. 3 is an electrical circuit diagram according to the system of this invention.

FIG. 3 is a diagrammatic circuitry illustration of a preferred embodiment of automatic supervisory system according to this invention. It will be seen that each detection unit 1 consists of a detector 2, an amplifier 3 and a priority indication device 4 and is connected to the central control unit 6 by a control line bundle 5.

The detector 2 is of a known type designed to convert the variation in yarn diameter into an electrical signal. Said detector, for instance, consists of a light source 8 and a photocell 9 disposed in opposed relation to allow the yarn 7 to run in the produced photoelectric field. A light emitting diode may be used as the light source 8 and a silicon solar battery as the photocell 9. In order to stabilize the detection sensitivity, said light source 8 and photocell 9 are connected by a compensating circuit 10 to form a loop circuit.

The output of said detector 2 is connected to the amplifier 3. Said amplifier 3 is constituted from a yarn run signal discrimination circuit 12 consisting of an amplifying circuit 11, a differentiation circuit 32, a shaping circuit 33 and an inverting circuit 34 and a double ends signal discrimination circuit 13 consisting of a size comparator 35, an integrating circuit 36 and a length comparator 37. The output of said amplifier 3 is connected to the priority indication device 4 and further connected to the central control unit 6 via a size control line 14 and a length control line 15.

The priority indication device 4 is constituted from an end break priority circuit 16, a double ends priority circuit 17 and a priority indicating circuit 18 consisting of a logical operation circuit 38 and an indicator 39. The output of said priority indication device 4 is connected to the central control unit 6 by an end break control line 19 and a double ends control line 20 and also connected to other priority indication devices 4 in the respective detection units 1 by a priority control line 21. A plurality of said detection units 1 are integrally arranged in correspondence to the respective yarns 7. They are also arranged in groups, the respective groups being connected in parallel to each other and further connected to the central control unit 6.

The central control unit 6 has a power source for driving said respective detection units 1, a power source 22 for size control and a power source 23 for length control, and it comprises an end break counter 24, a double ends counter 25, both being connected to each detection unit 1 by an end break control line 19 and a double ends control line 20, respectively, a switching mechanism 27 connected to said detection unit and to said counters through a logical operation circuit 26 for stop and also connected to a machine bed stopping device 31, and an end break indicator 29 and a double ends indicator 30 both of which are connected to said elements via a priority circuit 28.

The above-described embodiment of this invention will be further explained below from its operation aspect.

The yarn 7 may be a spun yarn of various types of natural or synthetic fiber or a filament twist yarn. When the yarn 7 runs in the photoelectric field in the detector 2 in a detection unit 1, a light volume variation signal is generated by the photocell 9 whenever a variation in diameter of the running yarn or a vibration thereof occurs. This relatively weak output signal is amplified by the amplifying circuit 11 and applied to the yarn run signal discrimination circuit 12 and the double ends signal discrimination circuit 13 in a parallel relation to each other.

The yarn run signal discrimination circuit 12 is constituted from a differentiation circuit 32, a shaping circuit 33 and an inverting circuit 34. When the yarn 7 runs in the detector 2, the photocell 9 emanates a light volume variation signal which is relatively weak and short in period, so this signal is amplified by the amplifying circuit 11, filtered by the differentiation circuit 32, converted into (1) or (0) level signal by the shaping circuit 33, and then phase-inverted by the inverting circuit 34. A (0) level signal is issued when the yarn is running and (1) level signal is given when the yarn movement is stopped.

On the other hand, the double ends signal discrimination circuit 13 is constituted from a size comparator 35, an integrating circuit 36 and a length comparator 37, and if the input signal thereto is inside the comparison level of each said comparator, its output signal is (0) level, but when a trouble, such as double ends, occurs on the yarn 7 and such yarn passes in the detector 2, the photocell 9 gives out a relatively strong and long-period light volume variation signal and this signal is input to the size comparator 35, and if such signal is higher than the comparison voltage applied to the other input of the size comparator 35, it issues an output signal to charge the integrating circuit 36. The charging voltage of the integrating circuit 36 rises proportionally to the duration of the output signal from the size comparator 35, that is, to the length of the period of the output signal from the photocell 9, and when the charging voltage of the integrating circuit 36 exceeds the comparison voltage of the length comprator 37, the latter issues an output signal of (1) level. If the output signal of the photocell 9 vanishes in a relatively short period, the charging voltage of the integrating circuit 36 also rapidly dies out and can not become higher than the comparison voltage of the length comparator 37. This means that in case the abnormality on the yarn 7 is of a relatively short span type such as slub or neps, the double ends discrimination circuit 13 gives no output; it issues an output signal only when the abnormality involves an elongated yarn trouble such as double ends. The size and length of the double ends to be detected can be optionally selected by adjusting the comparison voltage of said comparators 35, 37.

The output of said amplifier 3 is applied to the priority indication device 4. That is, the output of the yarn run signal discrimination circuit 12 is connected to the terminal $D_1$ of the end break priority circuit 16 and the output of the double ends signal discrimination circuit 13 is connected to the terminal $D_2$ of the double ends priority circuit 17, and an output is yielded from the output terminal $Q_1$ or $Q_2$ of either of said priority circuits 16, 17 in correspondence to whichever signal from said signal discrimination circuits 12, 13 that was given priority. It will be noted that the end break priority circuit 16 and the double ends priority circuit 17 are both a D type flipflop integration circuit, and thus when for instance (1) level signal is given to the input terminal $D_1$ of said end break priority circuit 16, the clock terminal $CK_1$ is changed from (0) to (1) level through a diode $R_1$, and accordingly (1) level of the input terminal $D_1$ is converted to the output terminal $Q_1$. The signal issued from the output terminal $Q_1$ of the end break priority circuit 16 is sent to the indicator 39 through the logical operation circuit 38 to let said indicator operate to give an indication.

On the other hand, the clock terminals $CK_1$, $CK_2$ of the priority circuits 16, 17 are connected in parallel to the corresponding clock terminals of the priority indication devices 4 in other detection units 1 by a priority control line 21, and thus when either of these clock terminals shifts to (1) level, other priority indication devices 4 are locked so that the priority circuits other than the one which had priority input issues no signal of (1) level from the output terminal even if (1) level signal is applied to the input terminal. Thus, only the indicator 39 in the priority indication device 4 in the detecting device 1 to which the signal has been input first of all is operated to give an indication, and the indicators 39 in any other priority indication devices 4 will not operate and will give no indication even if the machine bed is brought to a stop and an end break signal is issued from any other detection units 1. In case the signal is first applied to the input of the double ends priority circuit 17, the clock terminal $CK_2$ is converted from (0) to (1) level through a diode $R_2$ as in the previous case, and the indicator 39 is actuated through the logical operation circuit 38, which forms an OR circuit, to give an indication. The outputs of said end break priority circuit 16 and double ends priority circuit 17 are led to the central control unit 6 through diodes 40 and 41, respectively, and further connected to the end break counter 24 and double ends counter 25 and to the end break indicator 29 and double ends indicator 30 through a priority circuit 28. They are also connected to the switching mechanism 27 through a logical operation circuit 26. Said end break counter 24 and double ends counter 25 are both an integrating counter, and the signal produced in each control line 19, 20 is turned into a pulse and indicated by a cumulative count. The end break indicator 29 and double ends indicator 30 are given a priority selection by the priority circuit 28, and either of them is operated to make a successive indication by a display lamp or other means while (1) level signal is produced in each control line 19, 20. The logical operation circuit 26 is an OR circuit designed such that when a signal is generated in either of the control lines 19 or 20, said circuit issues an output signal to actuate the switching mechanism 27 which in turn operates the warping machine bed stopping device 31 to stop the machine bed. This also stops the rotation of the winding drum to stop the movement of the yarns 7.

In this way, in case an abnormality such as end break or double ends occurs on a running yarn 7, the indicator 39 in the priority indication device 4 in the detection unit 1 corresponding to the yarn in trouble is lighted and at the same time the end break indicator 29 or double ends indicator 30 on the central control panel 6 is lighted by discriminating the type of trouble. Further, with the end break counter 24 and double ends counter 25 being allowed to continue their counting operation, the machine bed stopping device 31 is actuated through the operation of the switching mechanism 27 to stop the warping machine bed. Upon stoppage of the warping machine bed, the worker can promptly make a repair work on the section in trouble as the type and location of the trouble are indicated by the indicators 29, 30, 39. When the trouble is removed and the machine operation is resumed, all the yarns again start to run and the input terminals $D_1$, $D_2$ of the priority circuits 16, 17 are turned to (0) level, while the preset terminals $PR_1$, $PR_2$ are set to (1) level by the output signals of the inverter circuits 42, 43 connected between said input terminals $D_1$, $D_2$ and preset terminals $PR_1$, $PR_2$. Also, the signals from the output terminals $Q_1$, $Q_2$ of the priority circuits 16, 17 are reset to (0) level, and the indicator 39 and end break indicator 29 or double ends indicator 30 automatically go out.

Figure 4:
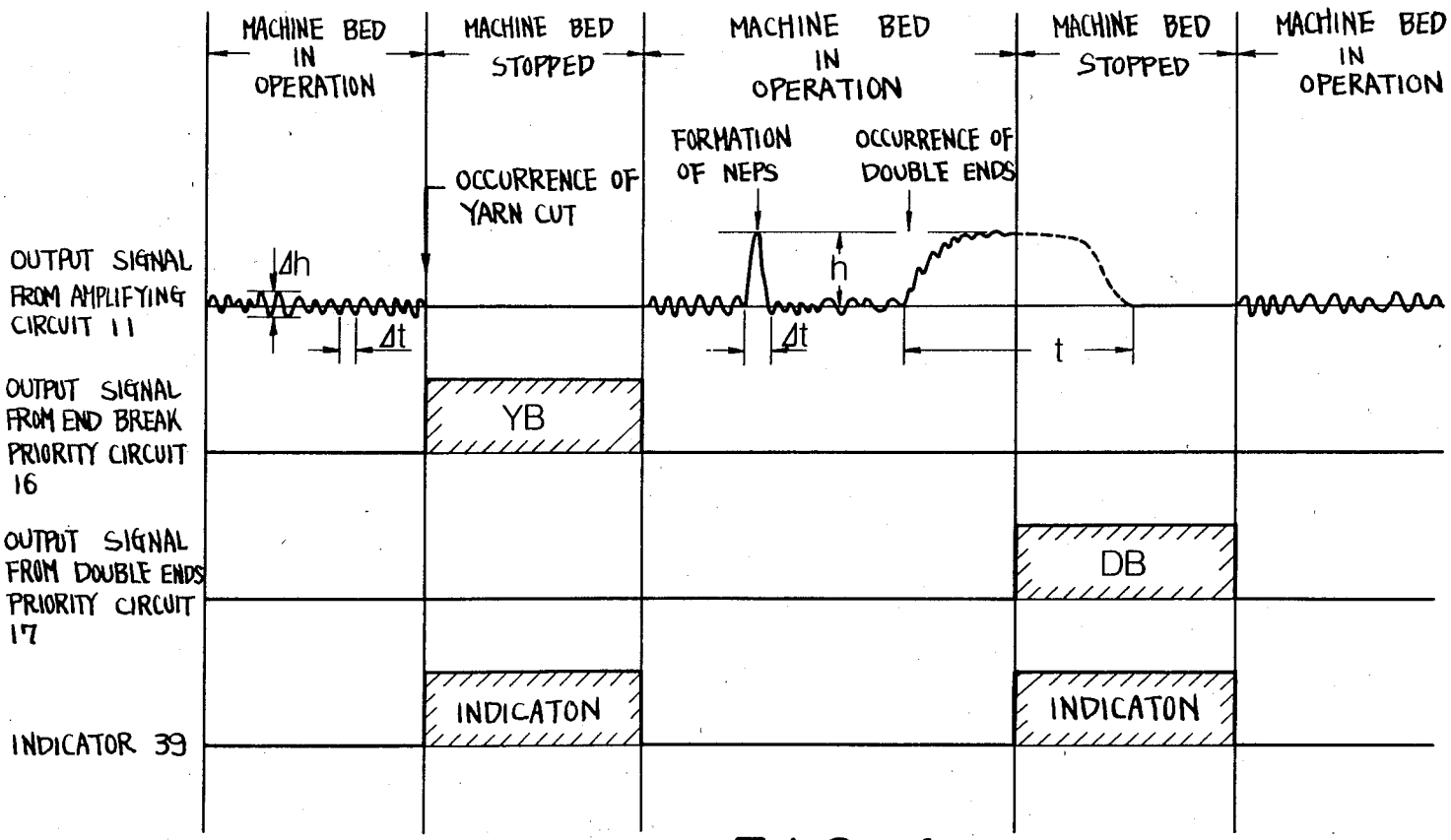
FIG. 4 is a diagram illustrating the electrical signal modes at the respective sections in the system of this invention.

The above-described operation will be better understood from the following additional explanation given with reference to FIG. 4.

In the amplifying circuit 11 in the amplifier 3, a yarn unevenness signal with a wave height of $\Delta h$ and a duration of $\Delta t$ is generated while the yarn runs, such signal being detected by the yarn signal discrimination circuit 12, and when an end break occurs, an end break signal is issued as shown by YB in FIG. 4 to stop the warping machine bed. Also, when a signal having a wave height of h and a duration t, indicative of occurrence of double ends or trouble of such sort, is generated in the amplification circuit 11, such signal is detected by the double ends signal discrimination circuit 13 to issue an output signal denoted by DB to stop the warping machine bed. In case the signal generated is of a relatively short period, such as having a wave height of h and a duration of $\Delta t$, as in the case of occurrence of slub, neps or such, no output is issued from the double ends signal discrimination circuit 13. The limits of detectable size and length of an abnormal section on a yarn 7 can be optionally selected by properly adjusting the power source for size control 22 and the power source for length control 23 in the central control unit 6 as stated before.

What we claim is:

1. An automatic supervisory system for a warper comprising:

at least one detection unit; and a central control unit;

said detection unit comprising a detector provided for each yarn to be wound on a warp beam to convert a variation in diameter of the yarn into an electrical signal, an amplifier including a yarn run signal discrimination circuit and a double ends signal discrimination circuit which serve to separate an output signal of said detector into a yarn run signal and a double ends signal, and a priority indication device including an end break priority circuit and a double ends priority circuit respectively receiving output signals from said yarn run signal discrimination circuit and double ends signal discrimination circuit, a logical operation circuit for indication and an indicator;

said central control unit comprising a switching mechanism for actuating a warping bed stopping device by means of an output signal from said detection unit, an end break indicator for indicating the occurrence of end break of a yarn and a double ends indicator for indicating the occurrence of double ends of a yarn, an end break counter for counting the number of end breaks which occurred and a double ends counter for counting the number of locations of doubles ends which occurred, and a control power source for variably setting the waveform shaping of said double ends signal discrimination circuit in said amplifier of said detection unit;

wherein upon the occurrence of end break or double ends of said yarn, said end break priority circuit or double ends priority circuit carries out the priority indication depending upon an output signal from said end break priority circuit or double ends priority circuit in said priority indication device to cause said end break counter or double ends counter to carry out the counting operation, and said indicator in said priority indication device selectively carries out the priority indication of said detection unit which has detected the end break or double ends and concurrently operates said warping machine bed stopping device through said switching mechanism.

* * * * *